US005440862A

United States Patent [19]

Sanchez-de-Leon-Rodriguez-Roda

[11] Patent Number: 5,440,862

[45] Date of Patent: Aug. 15, 1995

[54] AUTOMATIC FRUIT CONTAINER FILLER MACHINE

[75] Inventor: Juan A. Sanchez-de-Leon-Rodriguez-Roda, Valencia, Spain

[73] Assignee: Food Machinery Espanola S.A., Valencia, Spain

[21] Appl. No.: 297,935

[22] Filed: Aug. 31, 1994

[51] Int. Cl.[6] ..... B65B 35/30

[52] U.S. Cl. ..... 53/535; 53/543; 53/247; 53/260

[58] Field of Search ..... 53/531, 543, 535, 244, 53/247, 248, 260

[56] References Cited

U.S. PATENT DOCUMENTS

| | | | |
|---|---|---|---|
| 2,896,384 | 3/1958 | Carlsen et al. | 53/248 |
| 3,269,083 | 8/1966 | Marano | 53/535 |
| 4,081,096 | 3/1978 | Kupcikevicius | 53/259 |
| 5,325,653 | 7/1994 | Boyd | 53/248 |

*Primary Examiner*—John Sipos
*Assistant Examiner*—Gene L. Kim

[57] ABSTRACT

An automatic fruit container filler machine. Such comprises a structure (1) supporting an electric motor (3) which drives a carriage lift (2) carrying an endless belt (6) having rotary and conveyor movement to form a horizontal belt surface (6*b*) which can be positioned coplanar with a feeder (16) for a fruit layer (18*c*) and can then be positioned at a lower level namely at the bottom of the container (17) or the preceding fruit layer. At this position, the belt is retracted, and the fruit layer (18) is deposited at a position (18*a*) without the layer being hocked or changed.

The machine is applicable for filling containers with delicate fruit being extremely sensitive to hocking, such as apples, citrus fruits, tomatoes, peaches and the like.

2 Claims, 5 Drawing Sheets

AUTOMATIC FRUIT CONTAINER FILLER MACHINE

FIELD OF THE INVENTION

The present invention relates to an automatic fruit container filler machine which, in addition to the function for which it is designed, affords a number of advantages discussed hereinafter, and others that are inherent in its organisation and construction.

BACKGROUND OF THE INVENTION

Fruit container filler machines are already known of the kind designed to perform their filler function endeavouring, insofar as possible, to avoid the free fall of the fruit in order for the same not to be damaged on dropping, being necessarily applicable to certain kinds of delicate and extremely sensitive fruit such as citrus fruits, tomatoes, peaches or other like products.

Therefore, prior art has certain machines and devices devised to lay the fruit directly upon the container bottom in order to uniformly cover the surface of such bottom, do likewise on the next layer, and so on and so forth until the height of the full container is attained.

Current facilities comprise a container filling station arranged upon a platform travelling on an upright shaft. The lower end of a belt conveying the product enters the container bottom, eccentrically, to fill the same with the product whilst moving up, driven by a detector based upon the increase of the layers of such product.

These current systems perform their tasks turning the container whereas the unit unloading the fruit is in contact with such fruit, placing the same upon the said container, without being able to prevent the fruit from being knocked and moreover performing a faulty filling, since dependent upon the flow of fruit.

SUMMARY OF THE INVENTION

The applicants, because of their expertise in the subject field, have devised a fruit container filler machine overcoming the disadvantages and problems found in the prior art, the most outstanding advantage thereof being that the fruit is no longer knocked and the container is filled correctly and uniformly, with successive layers or levels.

Broadly speaking, the object of the invention relates to a machine comprising an upwardly elongate structure supporting an electric motor at its top which lifts and lowers a carriage holding an endless belt having a turning and conveying movement in order to establish a horizontal belt surface that can be positioned at an upper level, coplanar with an attached outer endless belt feeding a layer of fruit, and can be positioned at a lower level, namely at the bottom of the container or preceding layer of fruit, at which lower position the belt is retracted, by virtue of its conveying movement, in order to deposit the layer or level of fruit without knocking the same and without altering the formation of such layer or level of fruit, as provided by the feeder.

The machine according to the present Patent of Invention affords the aforesaid advantages, and others that will be easily inferred from the embodiment of an automatic fruit container filler machine described hereinafter in further detail to expedite the understanding of the features set out above, contemporaneously giving a number of details, this specification carrying attached to this end a number of drawings illustrating a practical embodiment of the invention, as an example only, without limiting the scope of such invention.

DESCRIPTION OF AN EMBODIMENT ACCORDING TO THE INVENTION

In accordance with the drawings, the fruit container filler machine subject of the invention and in accordance with a preferred embodiment thereof, comprises a general structure or framework, numbered -1-, which has an upwardly elongate shape, designed to support and have fixed the various components of the machine, which are basically a carriage -2- having ascensional movement through drive means -3-, a chain -21- and a balance weight -4-, which means allow the carriage to be located within a container -17- lying at the foot of the said structure -1- and in a position above and outside the said container.

Figure 1:
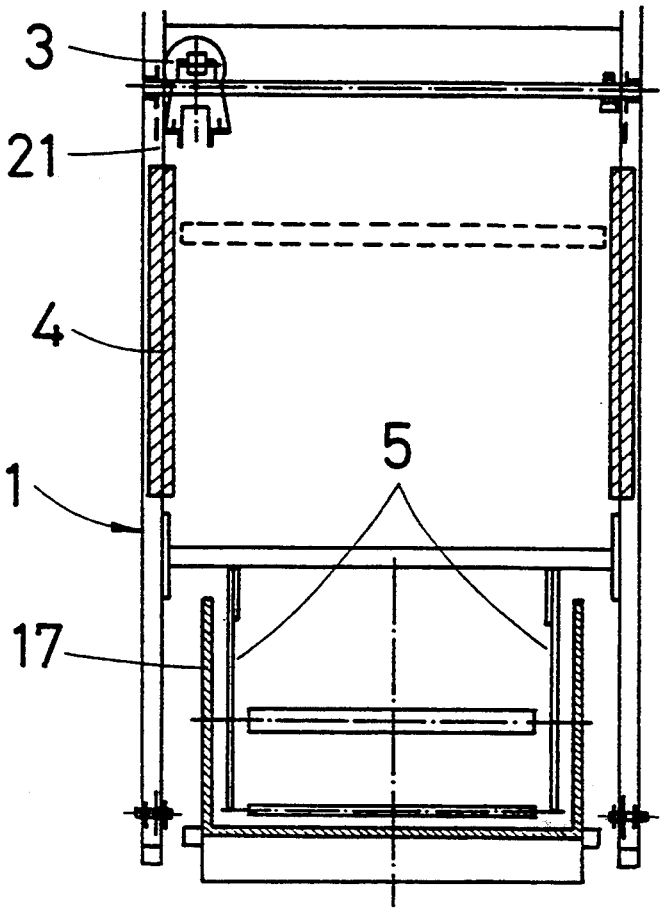
FIGS. 1, 2 and 3 show the automatic fruit container filler machine respectively as front elevation, side and plan views.
Figure 2:
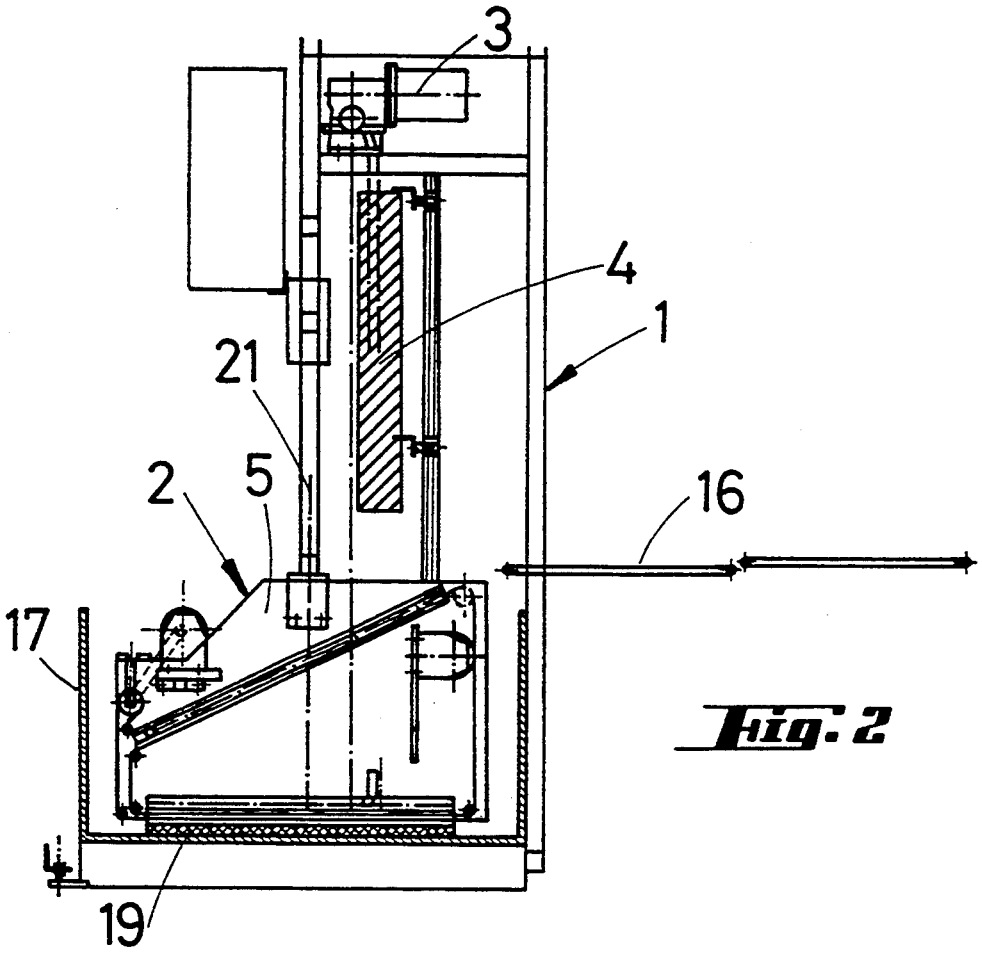
Figure 3:
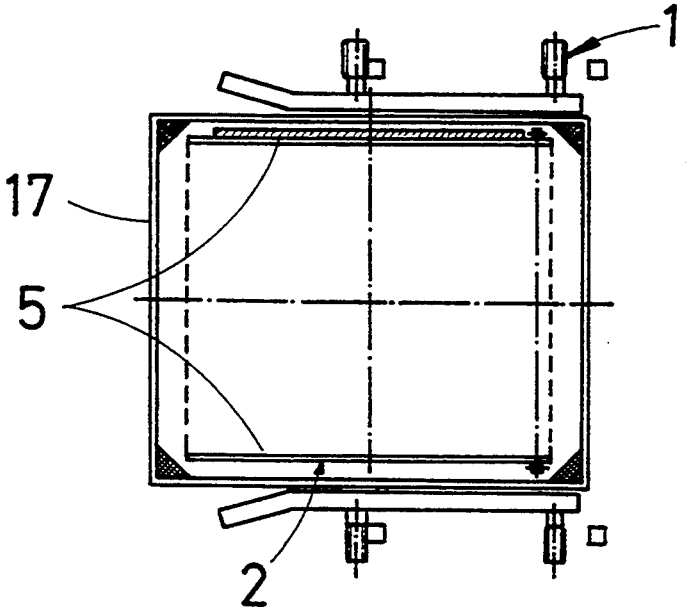
Figure 4:
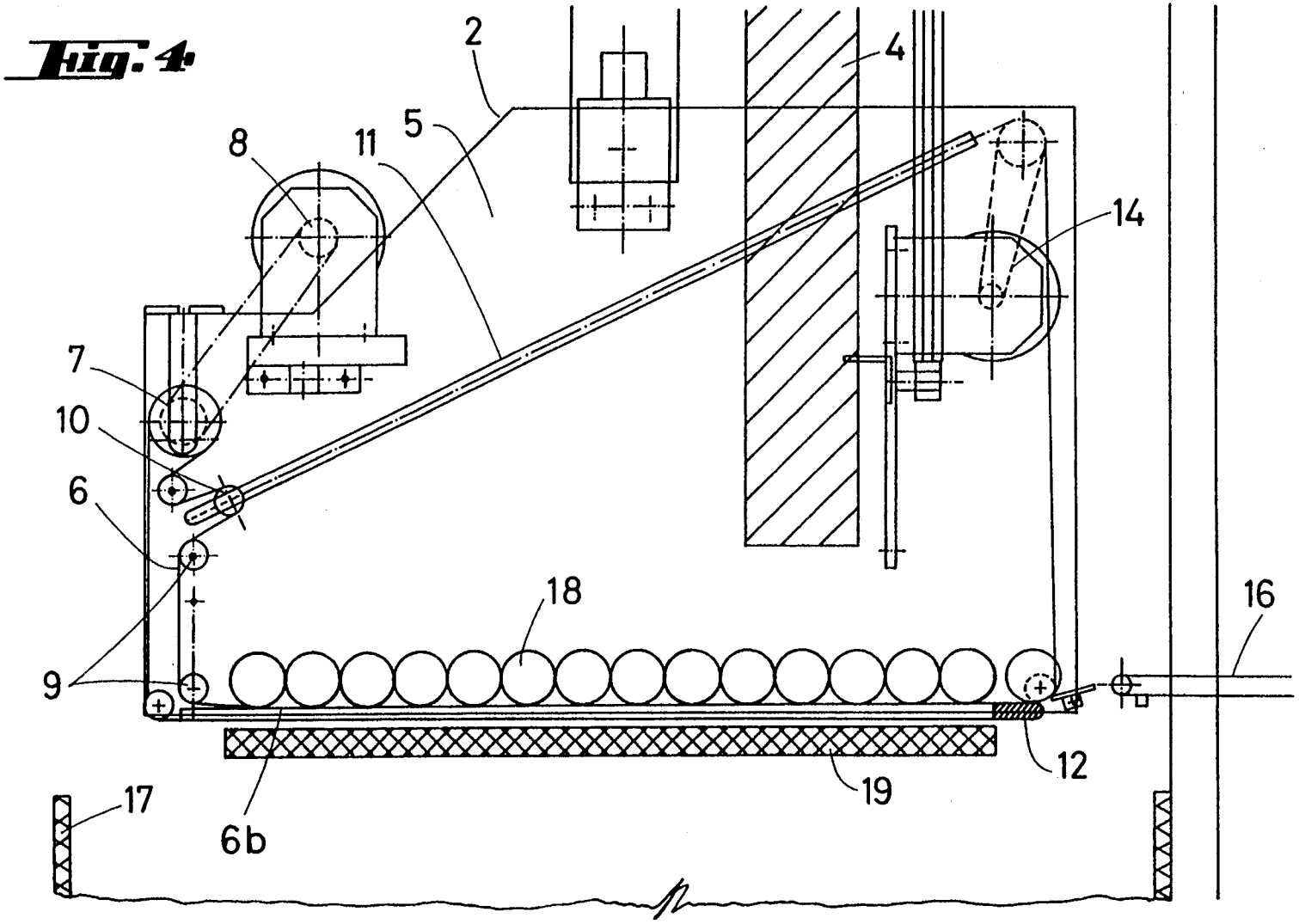
FIG. 4 shows a close-view of the carriage lift of the machine, in its raised position outside the container, coplanar with the feeding belt attached to the machine.

The said carriage -2- comprises two vertical and parallel plates or flanks -5- joined by transverse rollers -7-, -9- and -10- guiding an endless belt which surrounds a strip 12 -6-. The roller -7- is the drive roller and is connected to a motor -8- through the relevant transmission. Other rollers -9- solely guide and stretch the endless belt -6- whereas the roller -10- can also move along the slot guide -11-. A strip -12- across the carriage -2- can also move along the slot guide -13-. The said roller -10- and strip -12- are driven for movement by a motor -14- and a chain -15- fixed at its ends to the said roller and strip, and hence when the motor -14- turns in a given direction, it drives the roller -10- towards the highest part of the guide -11- and simultaneously draws the strip -12- back along its respective guide, in the opposite direction, and vice versa. In accordance with the above, as the case may be, an oblique endless belt section is obtained, numbered **-6*a*-, or a horizontal endless belt section is obtained, numbered -6*b*-, this section -6*b*-receiving a layer of fruit -18*c*- from the feeder endless belt -16- when the carriage -2- is fixed and in the raised positioned, in which the said section -6*b*- and belt -16- are coplanar, as shown in FIG. 4**.

In the lower carriage -2- position the horizontal belt section **-6*b*- lies close to the bottom of the container -17-, ready to transfer the fruit layer -18- to such bottom, according to -18*a*-. This operation to transfer the fruit from position -18- to position -18*a*- is carried out without knocking or rubbing the same, retaining the initial formation of the layer, because of the synchrony there is between the motor -8- causing the belt -6- to turn and the motor -14-** causing the belt to move away from the horizontal section -6*b*- which together causes the fruit to be moved but slightly.

The underside of the carriage -2- has a piece of foam -19- which acts as a deflector to avoid the fruit from coming into contact with the bottom of the container -17-, or preceding layer of fruit, a detector -20- acting when a distance "H" is reduced by the chain -21- movement, causing the motor -3- to stop and the said distance "H" to be recovered.

Figure 5:
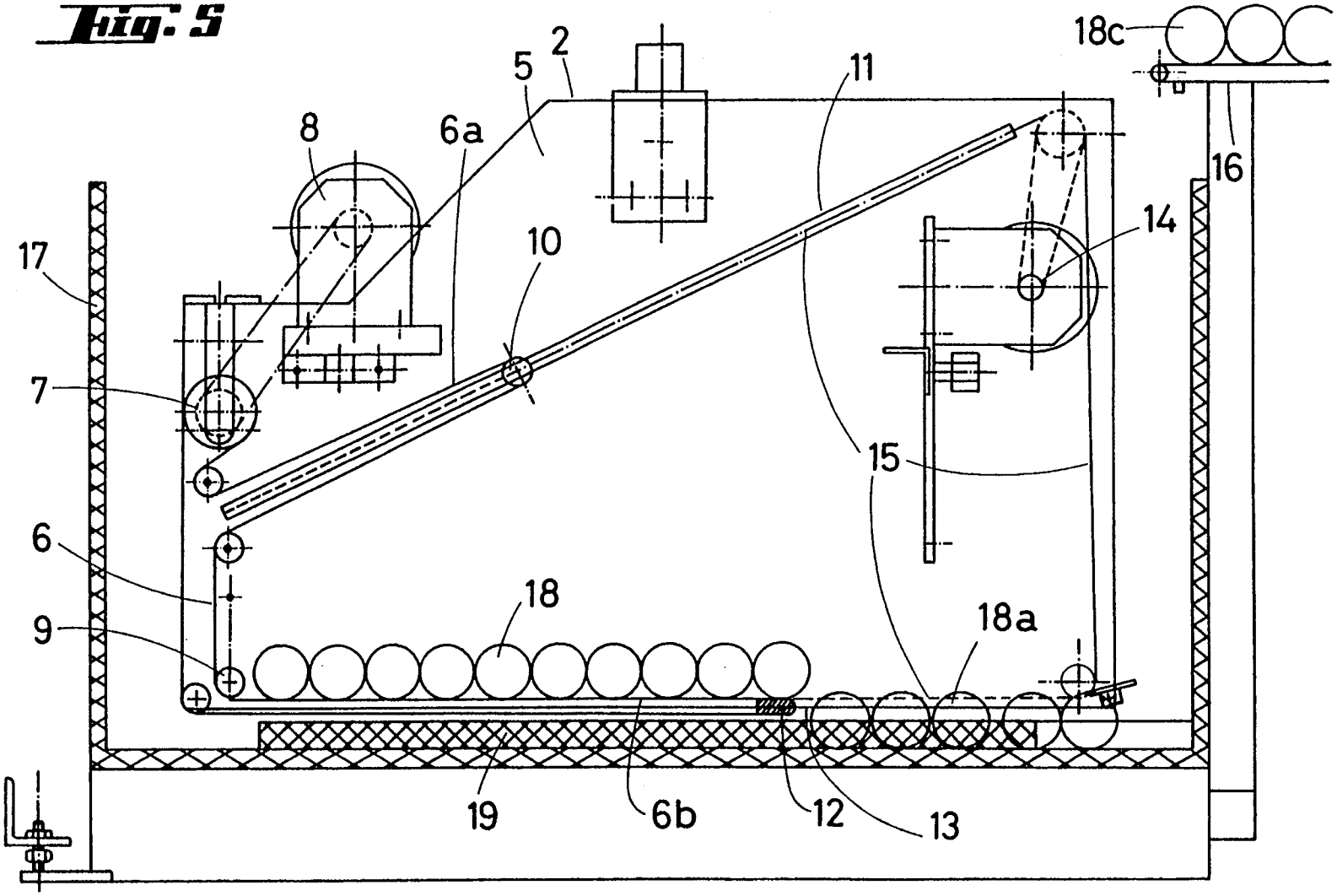
FIG. 5 illustrates the position of the carriage in a lowered position inside the container, when the container is being filled, with the initial layer fruit being placed.
Figure 6:
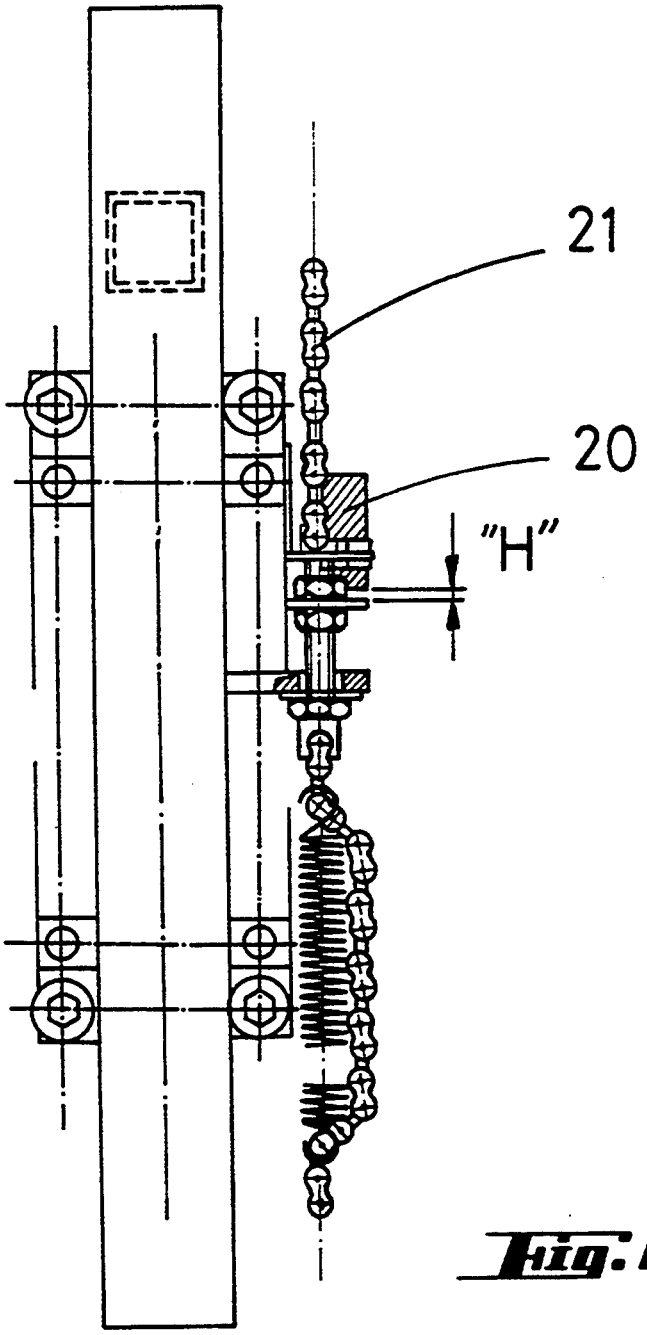
FIG. 6 is a close-view of a device with which the machine is fitted, designed to stop the carriage whilst being lowered, in such a way as to prevent the layer of fruit to be deposited upon the bottom of the container or preceding layer from being knocked, in order not to damage the fruit.

In accordance with the above, the machine works as follows:

When the belt -16- is full of a fruit layer -18*c*- feeding stops and a detector starts the said belt -16-, that lies coplanar with the belt section -6*b*-, to which the fruit is transferred, according to -18-, with the assistance of the movement of the latter, caused by a motor -8-. When the said belt section is full of fruit -18- a detector starts the motor -3- and causes the carriage -2- to be lowered down to the required height, in accordance with a detector which reveals the presence of the bottom of the container -17- or preceding layers of fruit, the motor -14- being started in order that it may, through the chain -15-, drive the roller -10- up and draw the strip -12- back at the same time, thereby reducing the surface of the section -6*b*- to deposit the fruit on the bottom of the container -17- or preceding fruit layer, as appropriate, as at number -18*a*- illustrated in FIG. 5. The motor -3- is again started to drive the carriage -2- up and the turning of the motor -14- is at the same time inverted now to drive the strip -12- and hence the horizontal belt section -6*b*- is again obtained for a new working cycle.

I claim:

1. An automatic fruit container filler machine, essentially characterized by comprising an upwardly elongate structure (1) supporting an electric motor (3) at the top which is designed for upward and downward movement of a carriage (2), conformed with two parallel flanks (5), sized to be housed within a standard container (17) that is designed to lie at foot of said structure (1), and which carriage is fitted with an endless belt (6) having a width equal to that of the carriage and a length in excess of a carriage length, such belt conforming a specific circuit that can be comprised within said carriage, this belt being connected to a first drive means (8) conferring it with slide movement turning about the transverse guide rollers (9) that are fixed at their ends to the flanks (5) of the carriage (2) and the belt (6) surrounding respectively a movable roller (10) and a movable strip (12) being equal in length to the width of the belt (6), the roller and strip taking up a horizontal position across the belt, said roller and strip being connected to a common second drive means (14) movable in either of two directions and which, depending upon the direction of movement, drive the roller (10) along an oblique and rising guide (11) lying on the higher part of the carriage flanks (5) or the strip (12), along a horizontal guide (13) lying on the lower part of said carriage flanks (5) detectors for controlling said first and second drive means to provide, opposed movements of the roller (10) and strip (12), defining, as the case may be, a horizontal belt section (**6*b*) along said guide which in raised carriage (2) position is positioned at the height of a feeding belt (16) which forms an integral part of the conventional fruit feeder, in order to transfer a fruit layer (18*c*) provided by said feeding belt (16) to said horizontal belt section (6*b*), whereas in lower carriage (2) position, said horizontal belt section (6*b*) is retracted, since the movement of said second drive means (14) is inverted, now moving the roller (10) allowing the belt section (6*b*) to be retracted to deposit the fruit layer (18) upon the bottom of the container (17), forming an initial filling layer (18*a*) in the container and thereafter upon preceding layers, until the container (17**) is filled.

2. An automatic fruit container filler machine, as in claim 1, characterised in that the first drive means (8) conferring rotary movement to the band (6) upon the respective guide rollers (9) are in synchrony with the second drive means (14) driving the movable roller (10) in order to allow the transfer of the fruit (18) to said filling (**18*a***) and successive positions, moving the same but slightly, to avoid knocking and rubbing, and not changing the formation of the layer.

* * * * *